US005297399A

United States Patent [19]

Tieken

[11] Patent Number: 5,297,399

[45] Date of Patent: Mar. 29, 1994

[54] MANUALLY OPERATED REFRIGERANT RECOVERY DEVICE

[76] Inventor: James B. Tieken, 2018 Woodlawn Ave., Indianapolis, Ind. 46203

[21] Appl. No.: 950,463

[22] Filed: Sep. 24, 1992

[51] Int. Cl.[5] ..... F25B 45/00

[52] U.S. Cl. ..... 62/292; 417/555.1

[58] Field of Search ..... 62/292, 77; 417/437, 417/555.1, 568

[56] References Cited

U.S. PATENT DOCUMENTS

| | | | |
|---|---|---|---|
| 1,284,641 | 11/1918 | Francis | 417/555.1 |
| 1,987,649 | 1/1935 | Wertz . | |
| 3,795,262 | 3/1974 | Post . | |
| 4,326,867 | 4/1982 | Stokes . | |
| 4,467,620 | 8/1984 | Bradley . | |
| 4,548,088 | 10/1985 | Hood, Jr. . | |
| 4,698,983 | 10/1987 | Hechavarria . | |
| 4,884,410 | 12/1989 | Bell et al. . | |
| 5,027,605 | 7/1991 | Hardesty . | |
| 5,138,847 | 8/1992 | Rollins . | |

*Primary Examiner*—John M. Sollecito
*Attorney, Agent, or Firm*—Woodard, Emhardt, Naughton Moriarty & McNett

[57] ABSTRACT

A manually operated refrigerant recovery device is disclosed that includes a piston/cylinder pump combination, wherein the piston defines opposing fluid chambers in the cylinder. A handle is attached via a connecting rod to the piston. First and second one-way check valves are provided at the pump inlet and outlet to ensure that fluid flows in only one direction through the pump. A pressure relief valve is in fluid communication with the fluid chamber opposite the pump chamber and is continuously manually adjustable between an open position and a closed position. The pressure relief valve is closed upon initial pressurization of the pump to dampen sudden upward movement of the handle and is open during pumping to facilitate manual pumping. In another embodiment, a manually operated refrigerant recovery device is disclosed which includes a piston/-cylinder pump combination, wherein the piston defines opposing fluid chambers in the cylinder. First and second one-way check valves are provided at the pump inlet and outlet, wherein the pump outlet is in fluid communication with the pump chamber and the pump inlet is in fluid communication with the fluid chamber opposite the pump chamber. Pressure equalization tubing connects the fluid chambers via a one-way check valve to provide damping against sudden upward movement of the handle.

8 Claims, 7 Drawing Sheets

MANUALLY OPERATED REFRIGERANT RECOVERY DEVICE

BACKGROUND OF THE INVENTION

The present invention relates generally to a device for manually pumping fluid in a sealed fluid system and, more specifically, to a manually operated refrigerant recovery device which pumps refrigerant from a fluid source to a recovery tank under pressure.

Due to environmental concerns, the use of chlorinated fluorocarbons (CFC) in coolants or refrigerants of air conditioning systems is being rapidly phased out. Further, existing air conditioning systems employing CFC refrigerants are subject to increased governmental regulation, one example being that CFC refrigerants must now be recovered rather than released into the atmosphere. As a result, refrigerant recovery devices are increasingly required in the servicing of air conditioning systems employing CFC refrigerants.

Previous refrigerant recovery devices have tended to be complex, and as a result, have been expensive both in initial cost and in recurring costs. For example, Rollins U.S. Pat. No. 5,138,847, although disclosing a refrigerant recovery apparatus which may be used on-site, still entails a somewhat complex and cumbersome system including a motorized pump, a condenser, a fan and both a temporary storage container and a receiving tank. Given the widespread use of CFC refrigerants, the Rollins refrigerant recovery system is too complex and costly to meet the needs of the average repairman. Therefore, a need exists for a refrigerant recovery device which is simple, inexpensive and adaptable to a variety of air conditioning systems.

Several hand-operated lubricant injection pumps are known that are used with refrigeration systems. These pumps are used to inject lubricant at atmospheric pressure into a pressurized compressor unit to replenish the oil in the crankcase of the compressor unit. Examples of these devices are shown in U.S. Pat. No. 4,698,983 to Hechavarria, U.S. Pat. No. 4,467,620 to Bradley et al. and U.S. Pat. No. 5,027,605 to Hardesty. One of the benefits of such a manual pump, for example, is the relative ease with which the average mechanic may inject additional lubricants into the air conditioning system of an automobile. However, these devices are not intended for use in a sealed fluid system to transfer fluids from a pressurized source to a pressurized recovery tank.

Therefore, a need exists for an improved refrigerant recovery device. Such a device should be simple, inexpensive and adaptable to a variety of refrigeration systems. Preferably, such a device should be manually operated to reduce its cost and complexity. Ideally, the device resists the corrosive effects common to refrigerants employed in air conditioning systems.

SUMMARY OF THE INVENTION

In one embodiment of the present invention, a device for manually transferring fluid in a pressurized fluid system is disclosed including a cylinder having an inlet and an outlet. A piston is movably disposed in the cylinder and defines a first and a second fluid chamber in the cylinder, wherein the first fluid chamber is in fluid communication with both the inlet and the outlet. A rod is attached to the piston and extends axially outward from within the cylinder, and a handle is attached to the rod external of the cylinder. A first one-way check valve is in fluid communication with the inlet, wherein the first one-way check valve enables fluid flow into the first fluid chamber. A second one-way check valve is in fluid communication with the outlet, wherein the second one-way check valve enables fluid flow out of the first fluid chamber. Adjustable valve means is provided for selectively venting the second fluid chamber, wherein the valve means restricts fluid flow out from the second fluid chamber to dampen movement of the handle.

In another embodiment of the present invention, a cylinder includes an inlet in fluid communication with a second fluid chamber and an outlet in fluid communication with a first fluid chamber. A first one-way check valve is in fluid communication with the outlet, wherein the first one-way check valve enables fluid flow out of the first fluid chamber. A second one-way check valve is in fluid communication with the inlet, wherein the second one-way check valve enables fluid flow into the second fluid chamber. Additionally, means for fluidly coupling the first fluid chamber to the second fluid chamber is provided. The fluid coupling means includes a third one-way check valve which enables fluid flow out from the second fluid chamber and into the first fluid chamber.

One object of the present invention is to provide an improved refrigerant recovery device.

Another object of the present invention is to provide a refrigerant recovery device that is simple, inexpensive and adaptable to a variety of refrigerant systems.

Yet another object of the present invention is to provide a refrigerant recovery device that is manually operated to reduce its cost and complexity.

Still another object of the present invention is to provide a manually operated refrigerant recovery device that is resistant to the corrosive effects common to refrigerants employed in air conditioning systems.

These and other related objects and advantages will become apparent from the following drawings and written description.

DESCRIPTION OF THE PREFERRED EMBODIMENT

Figure 1:
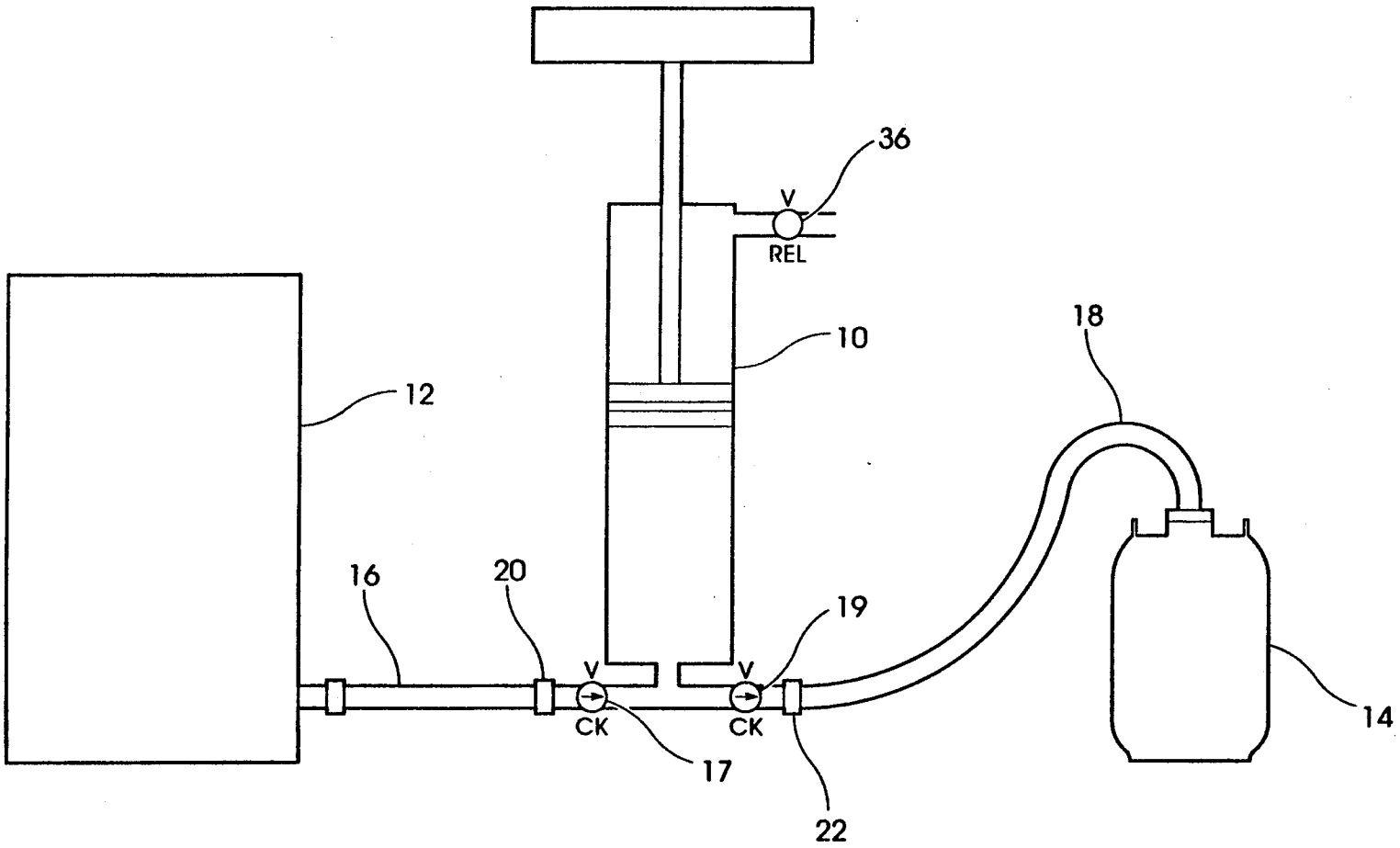
FIG. 1 is an illustration of a manually operated refrigerant recovery device according to one embodiment of the present invention connected to a refrigeration system.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a manually operated refrigerant recovery device 10 is shown in fluid communication with a refrigeration system 12 and a recovery tank 14. Refrigeration system 12 is typical of refrigeration systems that employ pressurized refrigerants such as chlorinated fluorocarbons (CFC) under pressure. One commonly known CFC refrigerant is referred to as "R-12". Given the potentially harmful effects such refrigerants have on the ozone layer, it is desirable to have a widely available, simple device that is capable of transferring refrigerants from a pressurized refrigeration system to a pressurized reservoir tank or vice versa. As such, device 10 provides a means by which pressurized refrigerant contained within system 12 can be readily pumped to recovery tank 14 with minimal loss of the refrigerant to the atmosphere.

Device 10 is in fluid communication with refrigeration system 12 and recovery tank 14 via high pressure tubing 16 and 18 and high pressure connectors 20 and 22. Connectors 20 and 22 are standard threaded refrigerant fittings known in the art, and in one specific embodiment are known as Schroeder valves. Such valves minimize leakage of refrigerant during connection and disconnection of device 10.

In usage, upon initial connection of device 10 to system 12 and tank 14, high pressure refrigerant flows from system 12 through tubing 16 into device 10, and from device 10 through tubing 18 into tank 14 until an equilibrium pressure is reached. Because the coolant expands to fill the larger volume of device 10 and recovery tank 14, the equilibrium pressure is reduced to a level below that normally found in system 10, but still at a level above atmospheric pressure. Therefore, device 10 is thereafter used to efficiently transfer or pump the remaining coolant or refrigerant from system 12 into pressurized tank 14. Device 10 is capable of pulling a vacuum in system 12 to substantially evacuate the remaining coolant. As such, device 10 meets or exceeds current regulations which specify that refrigerant recovery devices must pull down to 5 inches vacuum.

Figure 2:
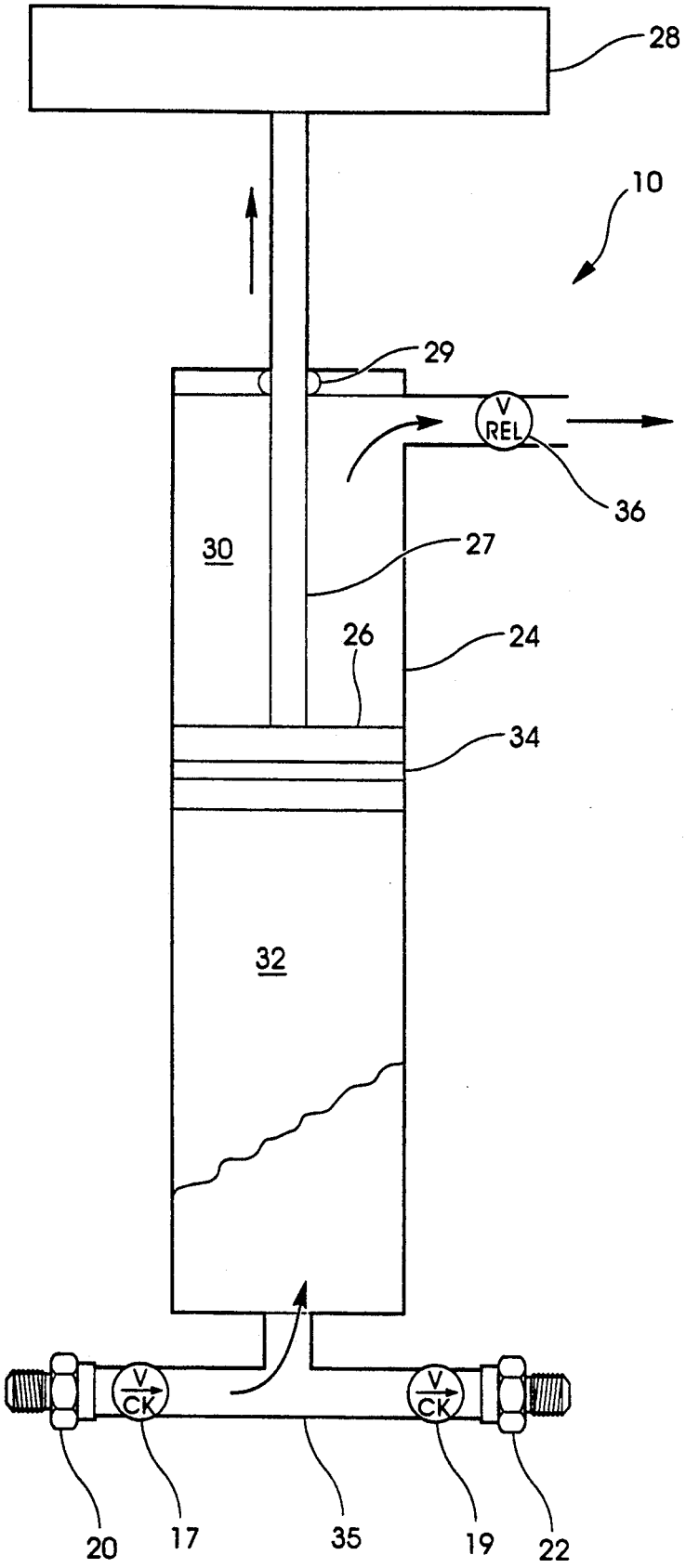
FIG. 2 is a cutaway view of the device depicted in FIG. 1 showing the direction of fluid flow during the upward stroke of the handle.
Figure 3:
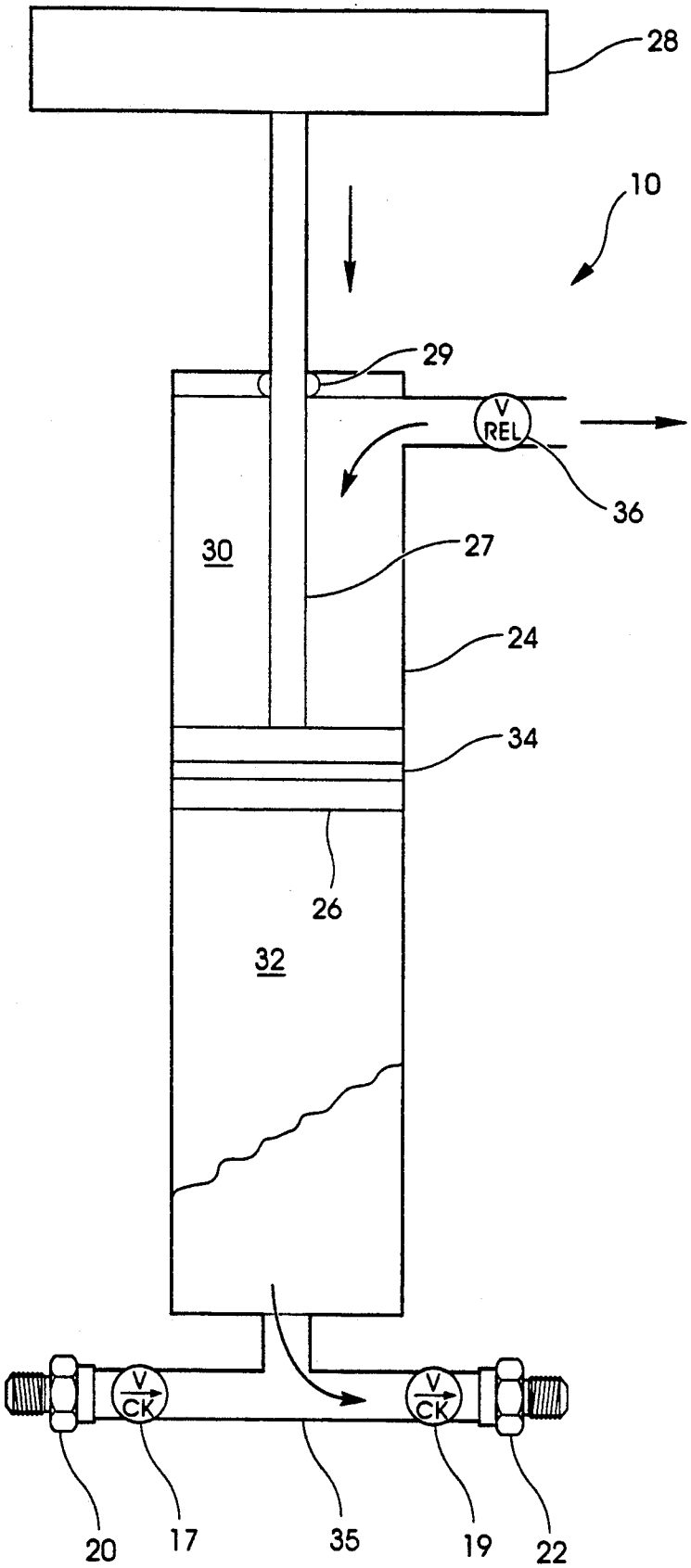
FIG. 3 is a cutaway view of the device depicted in FIG. 1 showing the direction of fluid flow during the downward stroke of the handle.

Referring now to FIGS. 2 and 3, the operation of device 10 is shown in greater detail. Device 10 includes a cylinder 24 having a pump piston 26 moveably disposed therein. A rod 27 is attached to piston 26. A handle 28 is attached to rod 27 to facilitate manual operation of device 10. Rod 27 extends axially outward from within cylinder 24 and, therefore, a seal 29 is provided to minimize leakage from chamber 30 through the rod/cylinder interface. Piston 26 defines within cylinder 24 opposing pressure chambers 30 and 32. As such, piston 26 includes a seal 34 to prevent fluid communication between chambers 30 and 32. In device 10, chamber 32 is in fluid communication with system 12 and is generally the high pressure fluid chamber. Conversely, chamber 30 is in fluid communication with the atmosphere via relief valve 36 and is generally the low pressure fluid chamber. Given the chance occurrence that some coolant leaks past seal 34 into chamber 30, chamber 30 is also contemplated as being in fluid communication with a second, low pressure refrigerant recovery tank.

To prevent pump piston 26 and handle 28 from rapidly accelerating upwards after the initial connection of device 10 to a tank or refrigeration system and subsequent release of high pressure refrigerant into device 10 and possibly injuring the user, a pressure relief valve 36 is attached to cylinder 24 in fluid communication with chamber 30. In the preferred embodiment, relief valve 36 is continuously manually adjustable between an open and a closed position to selectively vent chamber 30. However, relief valve 36 may be substituted with a restriction orifice which is choked during rapid acceleration of pump piston 26 and handle 28, thereby restricting flow and causing pressurization of chamber 30. Relief valve 36 may be initially closed to prevent venting of fluid contained within chamber 30 to the atmosphere upon initial pressurization of chamber 32. With relief valve 36 closed, piston 26 acts as a balance piston to equalize pressure between chambers 30 and 32, thereby dampening handle 28 against sudden acceleration.

Referring back to FIG. 1, when high pressure refrigerant is released from system 12 it enters device 10 through connector or inlet 20 via one-way check valve 17. Check valve 17 enables refrigerant to flow only from refrigeration system 12 into chamber 32. High pressure refrigerant pumped by device 10 exhausts through connector or outlet 22 via one-way check valve 19. Check valve 19 enables pressurized coolant to flow only from chamber 32 into recovery tank 14. After the refrigerant pressure reaches equilibrium, relief valve 36 is opened to vent chamber 30 to the atmosphere, thereby maintaining atmospheric pressure in chamber 30 to facilitate pumping.

Referring back to FIG. 2, the pumping action is shown in greater detail as indicated by the direction of the arrows. As handle 28 is drawn upward, refrigerant flows through one-way check valve 17 into chamber 32. Simultaneously, fluid in chamber 30 vents through open pressure relief valve 36 to the atmosphere. Conversely, in FIG. 3, as handle 28 is pushed downwards, refrigerant is pumped from chamber 32 through one-way check valve 19 into tank 14. Simultaneously, fluid flows into chamber 30 to prevent drawing down the pressure in chamber 30. During the upward stroke of handle 28, one-way check valve 19 prevents refrigerant downstream of device 10 from being drawn into chamber 32. During the downward stroke of handle 28, one-way check valve 17 prevents refrigerant from being pumped back into refrigeration system 12. As such, check valves 17 and 19 ensure that refrigerant flows in only one direction through device 10.

Because refrigerants are typically caustic as well as harmful to the environment, device 10 employs generally corrosion resistant materials in its construction, including a stainless steel piston 26/cylinder 24 and neoprene seals 34. In one specific embodiment, cylinder 24 and pump piston 26 are purchased as an integral cylindrical pumping unit such as SMC® Cylinder Model No. NCMB075-1200 rated at a maximum pressure of 250 psi (17.5 kgf/cm$^2$). Check valves 17 and 19 are compatible with standard Schroeder fittings and include male 45 degree flared ends threaded into a T-fitting 35. T-fitting 35 is threaded into cylinder 24 in fluid communication with chamber 32. Relief valve 36 and check valves 17 and 19 are similarly resistant to the corrosive effects of coolants and may be selected by one skilled in the art according to the particular application.

Figure 4:
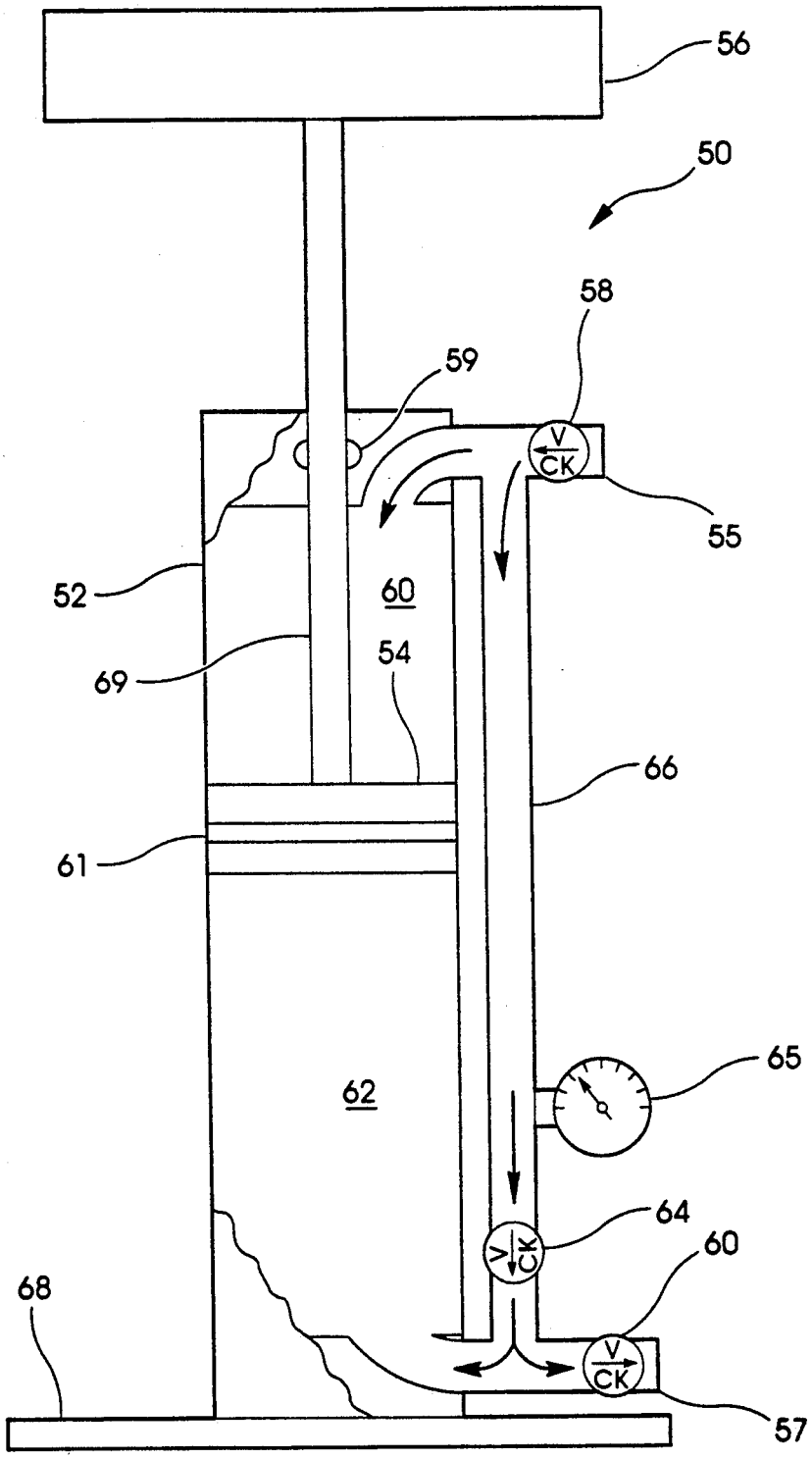
FIG. 4 is a cutaway view of a manually operated refrigerant recovery device according to another embodiment of the present invention.
Figure 5:
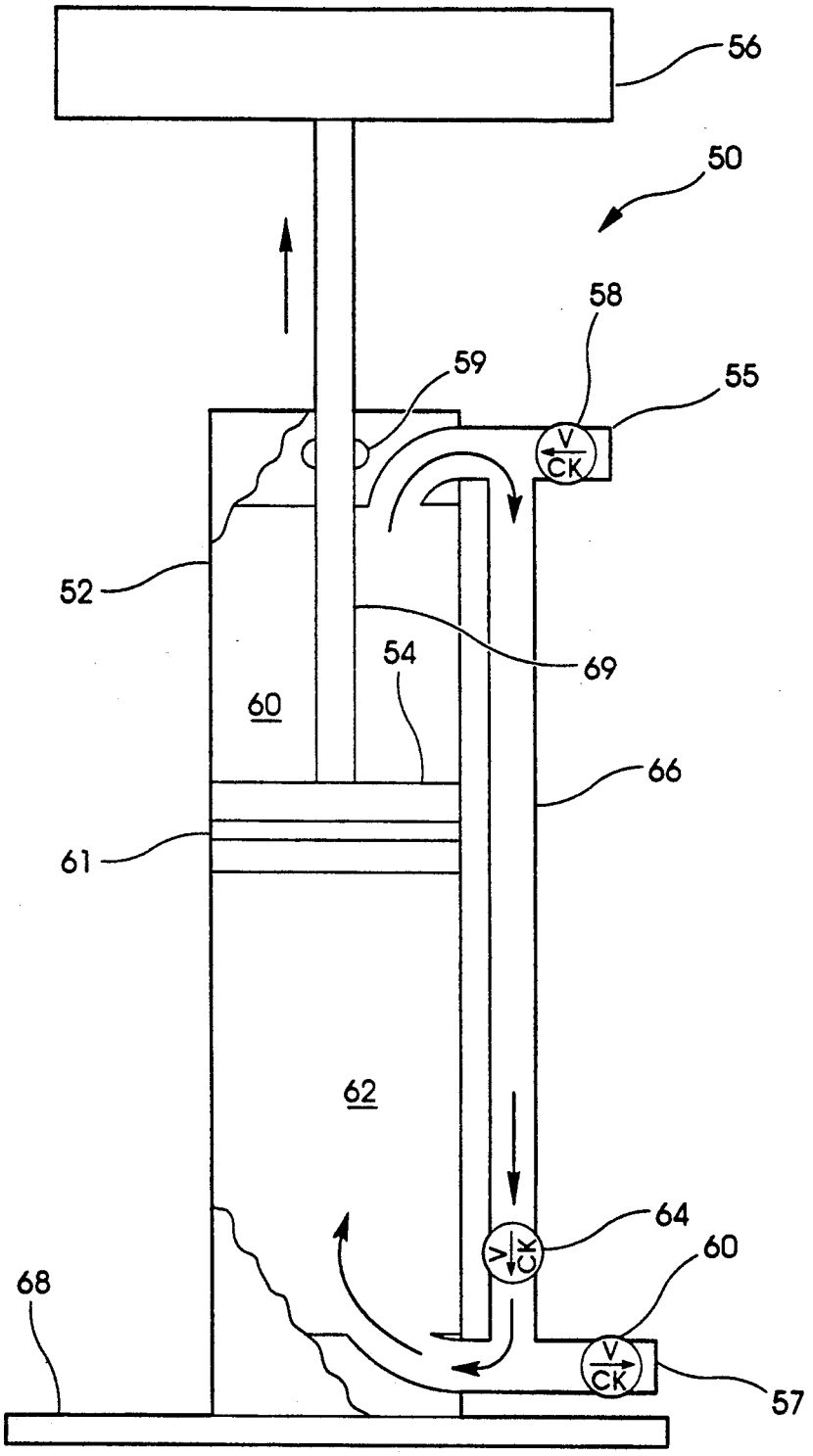
FIG. 5 is a cutaway view of the device depicted in FIG. 4 showing the direction of fluid flow during the upward stroke of the handle.
Figure 6:
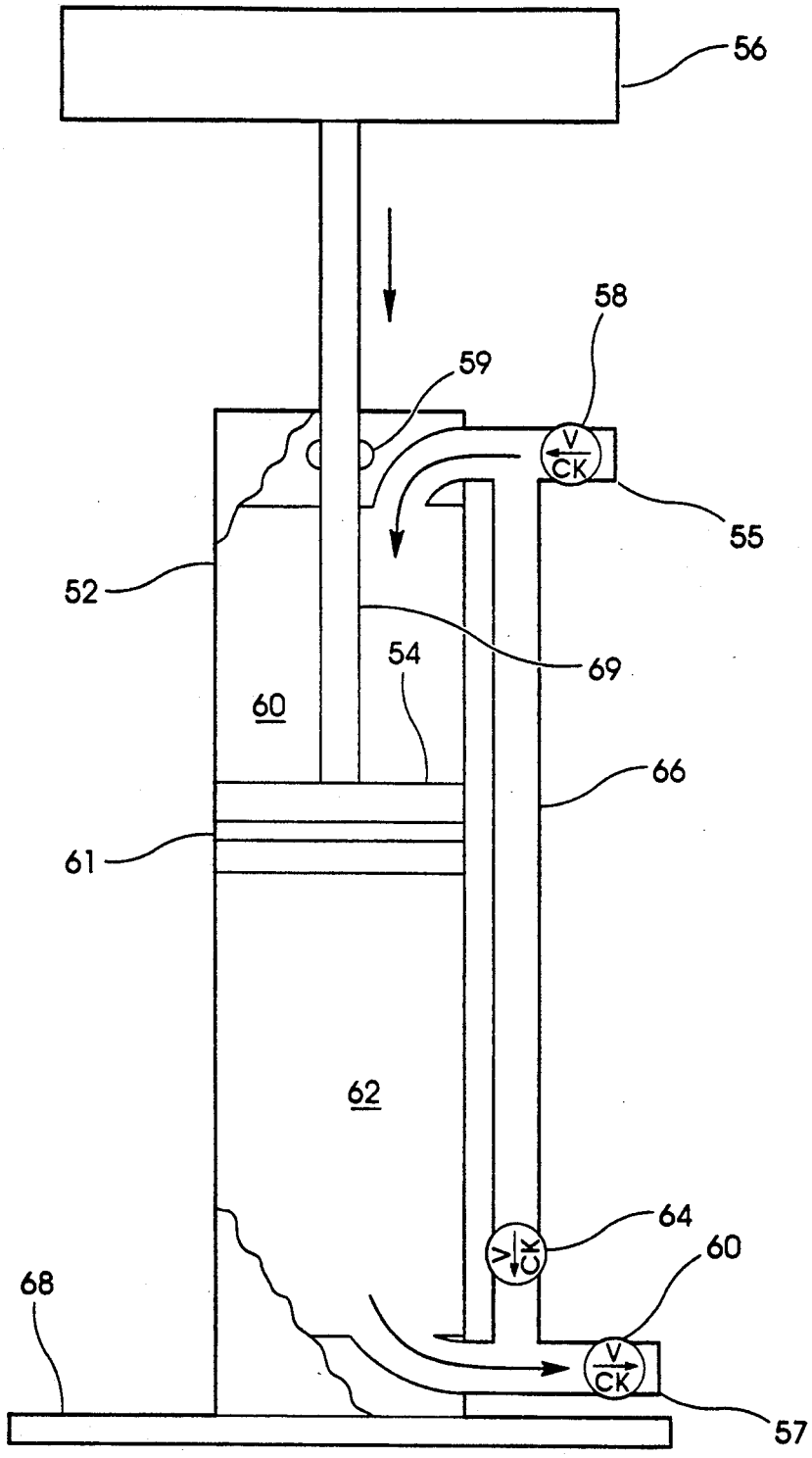
FIG. 6 is a cutaway view of the device depicted in FIG. 4 showing the direction of fluid flow during the downward stroke of the handle.

Referring now to FIGS. 4 through 6, another embodiment of a manually operated refrigerant recovery device 50 is shown. Similar to device 10, device 50 includes a cylinder 52 and a pump piston 54. A handle 56 attaches to piston 54 via connecting rod 69. Seals 59 and 61 are provided at the connecting rod/cylinder interface and piston/cylinder interface, respectively, to minimize leakage of fluid from within the pump to the atmosphere. Refrigerant enters device 50 through inlet 55 via one-way check valve 58 and is exhausted from device 50 through outlet 57 via one-way check valve 60. In usage with a refrigeration system and recovery tank similar to that shown in FIG. 1, refrigerant initially flows into device 50 through check valve 58 in the direction shown indicated by the arrows. Similar to device 10, pump piston 54 defines opposing fluid pressure chambers 60 and 62 within cylinder 52. However, unlike device 10, chambers 60 and 62 of device 50 are in fluid communication via pressure equalization tube 66 and one-way check valve 64. As such, device 50 does not include a pressure relief valve. Rather, pressure between chambers 60 and 62 is equalized via one-way fluid communication through tube 66. Because chambers 60 and 62 receive the same high pressure refrigerant, handle 56 is essentially maintained in equilibrium and therefore is not moved upwards upon the initial release of the refrigerant. Thereafter, manual pumping of the coolant is facilitated by the pressurized refrigerant acting on both sides of pump piston 54. Pressure/-vacuum gauge 65 provides immediate visual feedback concerning the pressure or vacuum levels in the refrigeration system connected to inlet 55.

Referring now to FIGS. 5 and 6, the pumping action of device 50 is more clearly shown. As depicted in FIG. 5, upward movement of pump piston 54 and handle 56 causes fluid to flow from chamber 60 to chamber 62, thereby creating a substantially circular fluid pathway with refrigerant flowing primarily through tubing 66 via one-way check valve 64. During the upward stroke, check valve 58 prevents fluid from flowing out of device 50 back into the refrigeration system, and check valve 60 prevents fluid from flowing out of the recovery tank back into device 50. Depending on local fluid pressure conditions immediately adjacent check valves 58 and 60, some fluid may enter device 50 from the refrigerant system or may exhaust from device 50 to the recovery tank. However, the primary pumping of the refrigerant from the refrigeration system to the recovery tank does not occur until the downward stroke of the piston hereinafter described in accordance with FIG. 6.

Referring now to FIG. 6, as indicated by the direction of the arrows, a downward motion of handle 56 causes fluid to move from chamber 62 through check valve 60 into the recovery tank. Simultaneously, fluid is drawn into chamber 60 through check valve 58. Check valve 64 prevents pressurized fluid from chamber 62 to flow back into chamber 60.

Figure 7:
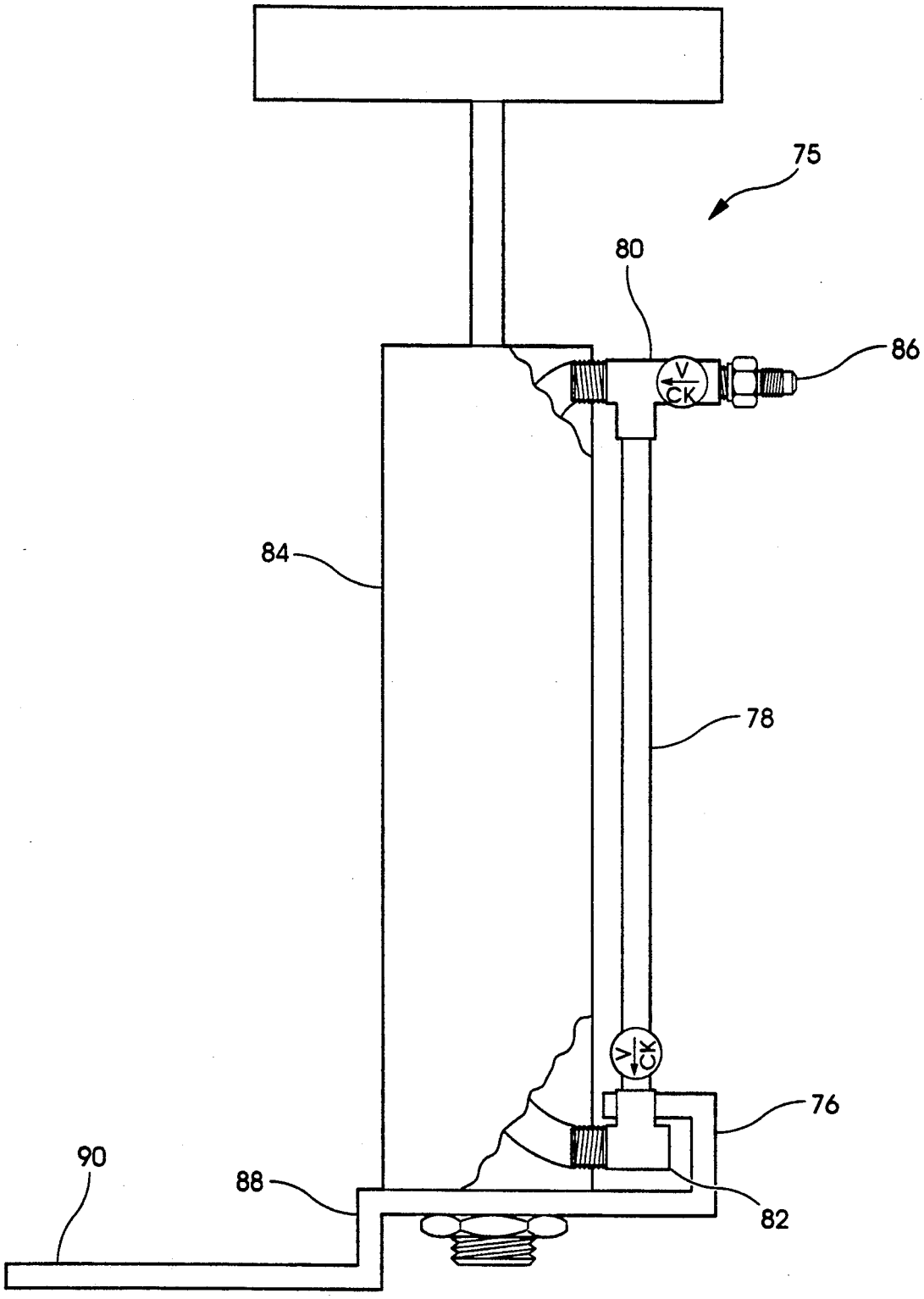
FIG. 7 is a cutaway view of a manually operated refrigerant recovery device according to a third embodiment of the present invention.

To further facilitate the pumping action of device 50, a foot stand 68 is included similar to that of a bicycle pump. However, other foot stands are contemplated as well which provide additional functions. For example, as shown in FIG. 7, an alternate embodiment of a manually operated refrigerant recovery device 75 is shown. Device 75 operates similarly to device 50 and includes a foot stand 76 that also protects against damage to the check valves and associated refrigeration tubing. In this specific embodiment, equalization tubing 78 includes a refrigeration inlet T-fitting 80 and a refrigeration outlet T-fitting 82. Fittings 80 and 82 threadably engage with cylinder 84 to facilitate fluid communication with a refrigeration system and a recovery tank, respectively. Fittings 80 and 82 each include a male 45 degree flared end for corresponding to mating ends standard with refrigeration systems (see, for example, flare 86 of fitting 80). As shown in FIG. 7, fitting 82 is oriented perpendicular to fitting 80 and protected by foot stand 76. Further, foot stand 76 includes a step 88 to provide clearance for mechanical attachment of cylinder 84 to foot stand 76. As such, an extended step portion 90 bears the weight of the user, while the remaining cantilevered portion of the foot stand 76 resists the pumping forces generated by the user. Generally speaking, all of the operating components of device 75 correspond with components of device 50.

It is also contemplated that the devices 10, 50 and 75 are functionally capable as recharging devices for transferring fluid from a refrigerant supply tank into a refrigeration system. Of particular value is the ability of these devices to draw a vacuum on the supply tank to evacuate a large percentage of the refrigeration from the tank, thereby eliminating wasted refrigerant.

As understood in connection with the devices 10, 50 and 75 shown and described in relation to the drawings, devices 50 and 75 are operationally interchangeable with device 10 of FIG. 1. Further, features shown in the devices 10, 50 and 75 may combined while still keeping within the spirit of the invention. For example, foot stand 68 may be adapted for use in combination with device 10, and foot stand 76 may be adapted for use in combination with either of devices 10 or 50. Similarly, specific construction details such as the SMC® cylinder model NCMB075-1200 and the Schroeder refrigeration fittings described above may be used interchangeably between the various embodiments.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for manually transferring fluid in a pressurized fluid system, said pressurized fluid system including a fluid source and a fluid reservoir, said device comprising:

a cylinder including an inlet and an outlet;

a foot stand attached to said cylinder wherein said foot stand includes a cantilevered portion elevated above a step portion, said cylinder being attached to said cantilevered portion;

a piston movably disposed in said cylinder, said piston defining a first and a second fluid chamber in said cylinder, sid first fluid chamber being in fluid communication with said outlet and said second fluid chamber being in fluid communication with said inlet;

a rod attached to said piston and extending axially outward from within said cylinder;

a handle attached to said rod external of said cylinder;

a first one-way check valve in fluid communication with said outlet, said first one-way check valve enabling fluid flow out of said first fluid chamber;

a second one-way check valve in fluid communication with said inlet, said second one-way check valve enabling fluid flow into said second fluid chamber;

means for fluidly coupling said first fluid chamber to said second fluid chamber, said means for fluidly coupling including a third one-way check valve enabling fluid flow out from said second fluid chamber into said first fluid chamber; and wherein said pressurized fluid is a refrigerant.

2. The device of claim 1, wherein said means for fluidly coupling is refrigeration tubing connected between said inlet and said outlet.

3. The device of claim 2, wherein said cantilevered portion extends over said outlet and a portion of said tubing to protect against damage.

4. The device of claim 3, further comprising fluid seals between said piston and cylinder and between said rod and said cylinder.

5. The device of claim 4, wherein said piston and said cylinder are constructed of stainless steel.

6. The device of claim 5, wherein said fluid seals are constructed of neoprene.

7. A device for manually transferring fluid in a pressurized fluid system, said pressurized fluid system including a fluid source and a fluid reservoir, said device comprising:

a cylinder including an inlet and an outlet;

a piston movably disposed in said cylinder, said piston defining a first and a second fluid chamber in said cylinder, said first fluid chamber being in fluid communication with said outlet and said second fluid chamber being in fluid communication with said inlet;

a rod attached to said piston and extending axially outward from within said cylinder;

first one-way valve means in fluid communication with said outlet, said first one-way valve means enabling fluid flow out of said first fluid chamber;

second one-way valve means in fluid communication with said inlet, said second one-way valve means enabling fluid flow into said second fluid chamber;

means for fluidly coupling said first fluid chamber to said second fluid chamber, said means for fluidly coupling including a third one-way valve means enabling fluid flow out from said second fluid chamber into said first fluid chamber; and a pressure/vacuum gauge attached to and in fluid communication with said means for fluidly coupling to provide a visual indication of the fluid pressure within said means for fluidly coupling.

8. The device of claim 7 including a handle attached to said rod opposite said piston and wherein said means for fluidly coupling is a tube having a check valve therein and wherein said tube provides a sealed fluid passage between said first and second fluid chambers.

* * * * *

UNITED STATES PATENT AND TRADEMARK OFFICE

CERTIFICATE OF CORRECTION

PATENT NO. : 5,297,399
DATED : March 29, 1994
INVENTOR(S) : James B. Tieken

It is certified that error appears in the above-indentified patent and that said Letters Patent is hereby corrected as shown below:

Column 6, line 63, replace "sid" with --said--.

Signed and Sealed this

Ninth Day of August, 1994

*Attest:*

*Attesting Officer*

BRUCE LEHMAN

*Commissioner of Patents and Trademarks*